US010682650B2

(12) United States Patent
Joechner

(10) Patent No.: US 10,682,650 B2
(45) Date of Patent: Jun. 16, 2020

(54) MINCING MACHINE FOR MINCING A PRODUCT

(71) Applicant: Karl Schnell GmbH & Co. KG, Winterbach (DE)

(72) Inventor: Eugen Joechner, Creglingen (DE)

(73) Assignee: KARL SCHNELL GMBH & CO. KG, Winterbach (DE)

( * ) Notice: Subject to any disclaimer, the term of this patent is extended or adjusted under 35 U.S.C. 154(b) by 929 days.

(21) Appl. No.: 14/830,016

(22) Filed: Aug. 19, 2015

(65) Prior Publication Data

US 2016/0051990 A1 Feb. 25, 2016

(30) Foreign Application Priority Data

Aug. 22, 2014 (DE) ..... 10 2014 216 720

(51) Int. Cl.
*B02C 18/30* (2006.01)
*B02C 18/36* (2006.01)
*B02C 18/06* (2006.01)

(52) U.S. Cl.
CPC ..... *B02C 18/30* (2013.01); *B02C 18/062* (2013.01); *B02C 18/301* (2013.01); *B02C 18/302* (2013.01); *B02C 18/304* (2013.01); *B02C 18/365* (2013.01)

(58) Field of Classification Search
CPC ... B02C 18/304; B02C 18/062; B02C 18/302; B02C 18/365; B02C 18/30; A22C 17/0026; B24B 3/366; B27G 13/00; B27G 13/005; B27G 13/007; B27G 13/02; B27G 13/04; B27G 13/06; B27G 13/08; B27G 13/10; B27G 13/12; B27G 13/14; B27G 13/16
USPC ..... 241/86.1, 84, 82.4, 82.7, 82.1; 83/200
See application file for complete search history.

(56) References Cited

U.S. PATENT DOCUMENTS 537,316 A * 4/1895 Stich ..... B02C 18/302 241/82.2
3,586,083 A 6/1971 Neuner
4,003,521 A * 1/1977 Hess ..... B02C 18/304 241/82.4
4,015,784 A 4/1977 Hughes
(Continued)

FOREIGN PATENT DOCUMENTS

CH 489279 A 4/1970
DE 1021745 B 12/1957
(Continued)

OTHER PUBLICATIONS

KS-Schneidsystem (Cutting System) FD/FL-Series Brochure, Karl Schnell GmbH & Co. KG, Winterbach, Germany.
(Continued)

*Primary Examiner* — Shelley M Self
*Assistant Examiner* — Jared O Brown
(74) *Attorney, Agent, or Firm* — Hackler Daghighian Martino & Novak

(57) ABSTRACT

A mincing machine for mincing a product, in particular for mincing meat, includes at least one stationary hole plate and at least one rotating hole plate which interact to mince the product. The mincing machine has a rotating cutter head mounted on a shaft wherein said cutter head is arranged upstream of the interacting hole plates in the conveying direction of the product to be minced in order to interact with a stationary hole plate to mince the product.

16 Claims, 2 Drawing Sheets

(56) References Cited

U.S. PATENT DOCUMENTS

| | | | | |
|---|---|---|---|---|
| 4,775,108 | A | 10/1988 | Schnell | |
| 4,966,332 | A | 10/1990 | Laska | |
| 5,566,895 | A | 10/1996 | Otto et al. | |
| 2003/0025016 | A1 * | 2/2003 | Domlatil | B02C 18/304 241/82.5 |

FOREIGN PATENT DOCUMENTS

| | | | | |
|---|---|---|---|---|
| DE | 11 17 438 | B | 11/1961 | |
| DE | 1432555 | A1 | 11/1968 | |
| DE | 225 0745 | A1 | 4/1974 | |
| DE | 39 15 409 | A1 | 11/1990 | |
| DE | 434 16 06 | A | 6/1995 | |
| DE | 295 128 20 | U1 | 10/1995 | |
| DE | 196 03 557 | A1 | 8/1997 | |
| DE | 199 60 409 | A1 | 6/2001 | |
| DE | 10 2007 025 899 | A1 | 12/2008 | |
| DE | 20 2010 003 036 | U1 | 6/2010 | |
| DE | 10 2010 055 786 | A1 | 6/2012 | |
| EP | 0 249 840 | A2 | 12/1987 | |
| EP | 031 27 48 | A2 | 4/1989 | |
| EP | 0 574 694 | A1 | 12/1993 | |
| GB | 924 862 | A | 5/1963 | |
| WO | 97 05953 | A1 | 2/1997 | |
| WO | 2008 145 310 | A1 | 12/2008 | |
| WO | 2012 095083 | A1 | 7/2012 | |
| WO | WO-2012095083 | A1 * | 7/2012 | B02C 18/304 |
| WO | WO 2012095083 | A1 * | 7/2012 | B02C 18/304 |

OTHER PUBLICATIONS

KS Feinstzerkleinerer (Emulsifiers) FD 225 D Brochure, Karl Schnell GmbH & Co. KG, Winterbach, Germany.

Google search results for "Zentrifugalschneidring" (centrifugal cutting ring).

* cited by examiner

MINCING MACHINE FOR MINCING A PRODUCT

CROSS-REFERENCE TO RELATED APPLICATIONS

This application claims priority to German Patent Application No. 10 2014 216 720.5, filed Aug. 22, 2014, the entire contents of which are hereby incorporated by reference.

DESCRIPTION

Field of the Invention

The present invention concerns a mincing machine for mincing a product, in particular for mincing meat, including at least one or at least two stationary hole plates and at least one rotating hole plate which interact to perform the mincing.

Background of the Invention

A mincing machine or emulsifying machine of this type for sausage products, for example, for sausage meat, or "sausage batter", is described in U.S. Pat. No. 4,015,784. The hole plates of the emulsifying machine are arranged one on top of the other along a vertical shaft wherein both the topmost hole plate, or "perforate ring", as well as the lowest hole plate are both driven by the shaft. The sausage "batter" is impelled into the holes of the topmost rotating plate by means of a centrifuge. Means are provided which rotate together with the lowest rotating hole plate to maintain the rotating motion of the sausage "batter".

Mincing machines are also known in which, respectively, a stationary hole plate interacts with a cutter head rotating in front of it to perform the mincing. In a mincing machine of this type, as described in DE 199 60 409 A1 and in DE 39 15 409 A1, a gap whose width is adjustable is formed between the respective hole plate and the cutter blades of the cutter head. In the case of this mincing machine, the hole plates are retained against stops inside a common axially adjustable adjuster which is mounted opposite the unadjustably arranged cutter head. The gap between the hole plate and the respective cutter head can be adjusted jointly by the adjuster. The adjuster can be formed by a sleeve which is rotatably mounted with an external thread in a corresponding internal thread of the machine housing and which in addition has an external gear rim which is coupled to an adjusting motor via a worm shaft.

CH 489279 describes a mincing machine which has at least one hole plate over which cutter blades are spring-loaded against the hole plate and retained rotatably in a multi-armed cutter head. A blade holder movable axially to the hole plate is provided which receives the cutter blades in motion and which the force of a spring element forces against the hole plate.

A device for emulsifying minced organic masses, substances and/or liquids is known from DE 196 03 557 A1. A rotating measuring arrangement and a hole plate arrangement can be moved axially on a shaft against an ejector. When a solid object is detected, the measuring device is able to raise automatically from the particular hole plate, or respectively, the hole plate can be displaced in the other direction to avoid jamming.

A mincing machine for agricultural products is known from DE 1432555 in which rotating cutter blades are arranged in front of at least one hole plate. The gap between the hole plate(s) and the rotating cutter blades can be adjusted by moving a horizontally aligned drive shaft for the cutter blades in the axial direction. A hand wheel is provided on the mincing machine for moving the drive shaft.

The object of the present invention is to further develop a mincing machine of the type described at the beginning in order to improve the quality of the product involved in the mincing.

SUMMARY OF THE INVENTION

This object is attained by a mincing machine of the type described at the beginning which is characterized by a cutter head mounted rotatably on a shaft, said head being arranged in the conveying direction of the product being minced upstream of the hole plates in order to interact with a stationary hole plate in the mincing of the product. The stationary hole plate can involve in particular the first stationary hole plate of the interacting hole plates.

It has been shown in trials that the type of mincing has an effect on the consistency and the coloring of the minced product: during the interaction of the hole plates, the mincing of the product takes place at the edges of the holes in the stationary and rotating hole plates. Since the angles of the cutting edges, or more precisely, the shear edges, are at 90°, a blunt or negative cut is produced, i.e. no granular particles are produced and the product (cut material) is more battered or crushed than cut. For this reason, the minced product appears creamier than is the case when mincing by means of a cutter head in combination with a hole plate, or, respectively, when mincing with a centrifugal cutting ring (rotor-stator).

It has been shown that the combination of mincing by the interacting hole plates with preliminary mincing by the cutter head produces a minced product at a higher quality, particularly in the case of fibrous, sinewy products. In addition, the arrangement of the cutter head before the hole plates has the advantage that the product feed to the hole plates is improved since the cutter head exerts a centrifugal force on the product being minced and, if the cutter blades are arranged in a suitable oblique direction, the product is pressed against the first stationary hole plate.

In an advantageous embodiment, the shaft is mounted horizontally. Due to the use of the cutter head which serves to convey the product, it is not absolutely necessary to align the shaft vertically in order to feed the product through the hole plates using gravity. If the conveying of the product needs to be supported, a rotating ejector can be installed, for example, downstream of the hole plates in the conveying direction.

Preferably, the rotating hole plates are coupled to the shaft to move with it, i.e. the shaft serves as the drive for the rotating hole plates. Both the cutter head as well as the rotating and stationary hole plates are arranged typically along the same driven shaft. The rotating hole plates may be mounted rigidly, or fixed in rotation, on the shaft. In this case, the hole plates and the cutter head rotate as the shaft turns with the same rotational speed which has proved to be advantageous for conveying the product.

It is particularly preferable if an axial gap between the cutter head and the stationary hole plate, with which the cutter head interacts, is adjustable. The stationary hole plate and/or the cutter head can be moved in the axial direction for adjusting the gap. Moving the stationary hole plate in the axial direction can be carried out, for example, as described further above such that an adjuster to which the stationary hole plate(s) abut(s), is moved in the axial direction inside a housing while the shaft stays in position with the cutter head in the axial direction. The adjuster can be formed, for example, as a sleeve which is rotatably mounted with an external thread in a corresponding internal thread of the housing. The distance over which the axial gap can be varied amounts as a rule to a few millimeters. This is sufficient to affect the degree of pre-mincing of the product as well as the throughput quantity and the heat transferred into the product. The axial movement of the shaft can take place as it rotates also. By reducing the gap, the cutter blades of the cutter head in this case can be brought into contact with the stationary hole plate if they need resharpening.

In a preferred further development, the shaft is mounted to be movable axially. In this case, the stationary hole plates are typically fixed in position, i.e. they remain inside the housing in their axial position as the gap is being adjusted and the shaft is moved together with the cutter head which is mounted on the shaft, fixed in the axial direction and moves with the shaft.

If the same shaft is used as the drive shaft for the rotating hole plates and for the cutter head, the problem that the rotating hole plate(s) is/are arranged at an extremely small distance (in the order of one or more thousandths of a millimeter) from the stationary hole plates does arise regardless of whether the stationary hole plate(s) or the shaft is or are moved in the axial direction. The stationary and the rotating hole plates lie practically against each other and are separated just by a very thin film of lubricant formed by the product itself. The axial gap between the stationary and the rotating hole plates cannot be changed in practice therefore.

In a further development, the force transfer of the shaft to the rotating hole plates is carried out by driving pins movable in the axial direction relative to the rotating hole plates. The driving pins can be fitted to a rotating driving bush which is attached to the shaft, fixed in place in the axial direction. When the shaft is moved in the axial direction to adjust the gap, the driving pins are moved slightly, i.e. by a few millimeters, relative to the rotating hole plates (and, therefore, to the stationary hole plates). Thus it is possible to adjust the gap between the stationary hole plate and the cutter head interacting with it in an advantageous way. In this, the free ends of the driving pins are accommodated typically in holes of a cover which remains fixed in location in the axial direction and is rotated together with the driving bush and the rotating hole plates around the shaft. The axial gap between the driving bush and the cover is chosen such that the free ends of the driving pins always remain in the holes in the cover during the axial movement.

In yet a further development, the mincing machine has two rotating hole plates which are attached on opposite sides of a spacer ring wherein a stationary hole plate is fitted between the two rotating hole plates. The stationary hole plate has a central opening to accommodate the spacer ring. The two outer hole plates of this type of assembly are connected together by the spacer ring in a rotatably fixed manner. The inner hole plate can be rotated relative to the spacer ring, or, respectively, relative to the outer hole plates. When installing the assembly into the housing of the mincing machine, the entire assembly is slid on to the shaft, or, respectively, the shaft is inserted through a central hole in the spacer ring and in the three hole plates. The inner stationary hole plate is fixed in the housing and the two outer hole plates are rotated together with the spacer ring when the mincing machine is operating. A respective further stationary hole plate interacting with the respective rotating hole plate to mince the product finer can be arranged in the housing of the mincing machine immediately next to the surface of the rotating hole plates. The hole plates can be clamped together by means of a guide ring and connected to form a hole plate module. Naturally, optionally, more than five hole plates can be connected together to form a hole plate module so that it can be installed on the shaft of the mincing machine as one assembled unit. By attaching the two rotating hole plates together, they are stabilized and are prevented from wobbling as they rotate around the shaft.

In a further advantageous development, the driving pins pass right through through-holes in the spacer ring. This makes it possible to move the shaft in the axial direction relative to the hole plate module fixed in the housing in the axial direction as well as relative to other stationary hole plates optionally present in the housing.

In one embodiment, the diameters of the holes of a hole plate at the front in the conveying direction of the product are smaller than the diameters of the holes of at least one hole plate succeeding in the conveying direction of the product. The hole plate at the front in the conveying direction of the product can mean particularly the first stationary hole plate of the hole plates interacting to perform the mincing.

In contrast to the prior art in which the diameter of the holes of the hole plates remain the same or diminish in the conveying direction of the product, because the cutter head is mounted at the start in the conveying direction, it is possible in the case of the mincing machine described herein to select the diameter of the holes in the holes plates forward in the conveying direction to be smaller than the diameter of the holes of hole plates further down in the conveying direction. Naturally, alternatively the diameters of the hole plates can remain the same or decrease in the conveying direction as in the prior art. By providing the cutter head, the flexibility in the choice of diameters of the hole plates increases which has an advantageous effect on the quality of the respective minced product.

In a further embodiment, an ejector, mounted on the shaft and driven by the shaft, is fitted in the conveying direction after the hole plates. The ejector serves to maintain the rotary motion of the product before it is discharged through an outlet, or outlet housing, out of the mincing machine. The conveying of the product can be aided by applying suction from the outlet side.

Preferably a further stationary hole plate to interact with a further cutter head is arranged before the cutter head in the conveying direction of the product to be minced. By providing one or, optionally, several pairs like this which are formed from a stationary hole plate and a rotating cutter head, it is possible to obtain better pre-mincing of the product. One or several additional pairs can be installed as additional options in the mincing machine depending on the product to be minced.

In an advantageous embodiment, a centrifugal cutting ring is arranged downstream of the hole plates in the conveying direction. A centrifugal cutting ring forms a cutter set based on the rotor-stator principle. The rotor typically is arranged located radially inwards and surrounded by the annular stator located radially outwards. The rotor has cutter blades which interact with cutting slots in the stator to mince the product with a kind of shearing cut. Because of the centrifugal force generated by the rotation of the rotor, the product is transported radially outwards into the shearing zone between the rotor and the stator and the product is fed radially outwards through the cutting slots of the stator. In the shearing zone, the rotor creates a cutting movement and the stator acts as an opposing shear. The additional use of the centrifugal cutting ring enables the mincing of a product to be undertaken to a defined particle size, such as that required for producing baby food.

Other advantages of the invention arise from the description and the drawings. Furthermore, the features cited above and those to be stated below can be applied as they stand or in any other combinations. The illustrated and described embodiments are not to be taken as an exhaustive list but, instead, serve to describe the invention by way of exemplified features.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
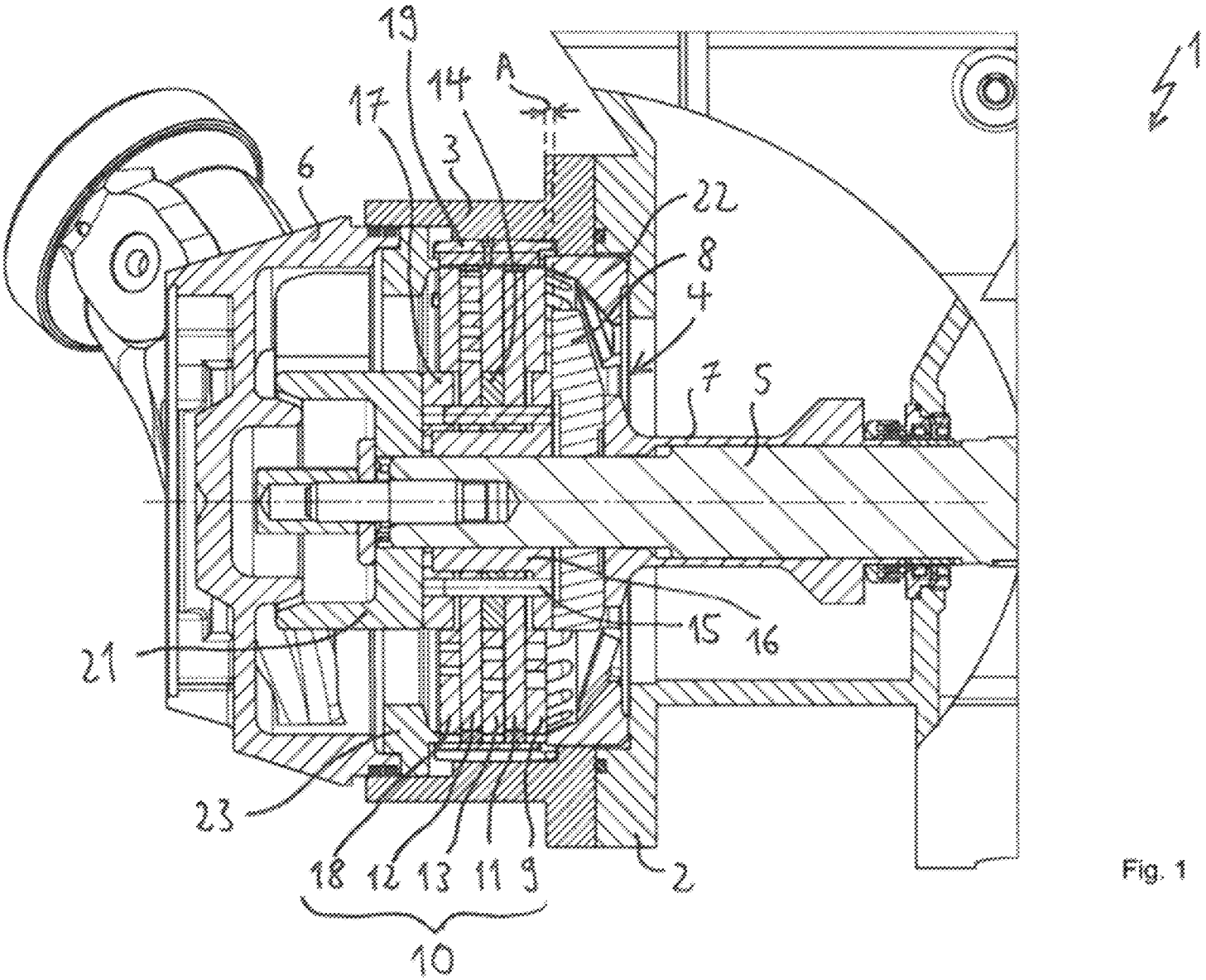
FIG. 1 is a diagrammatic illustration of a cross section through an embodiment of a mincing machine according to the invention.
Figure 2:
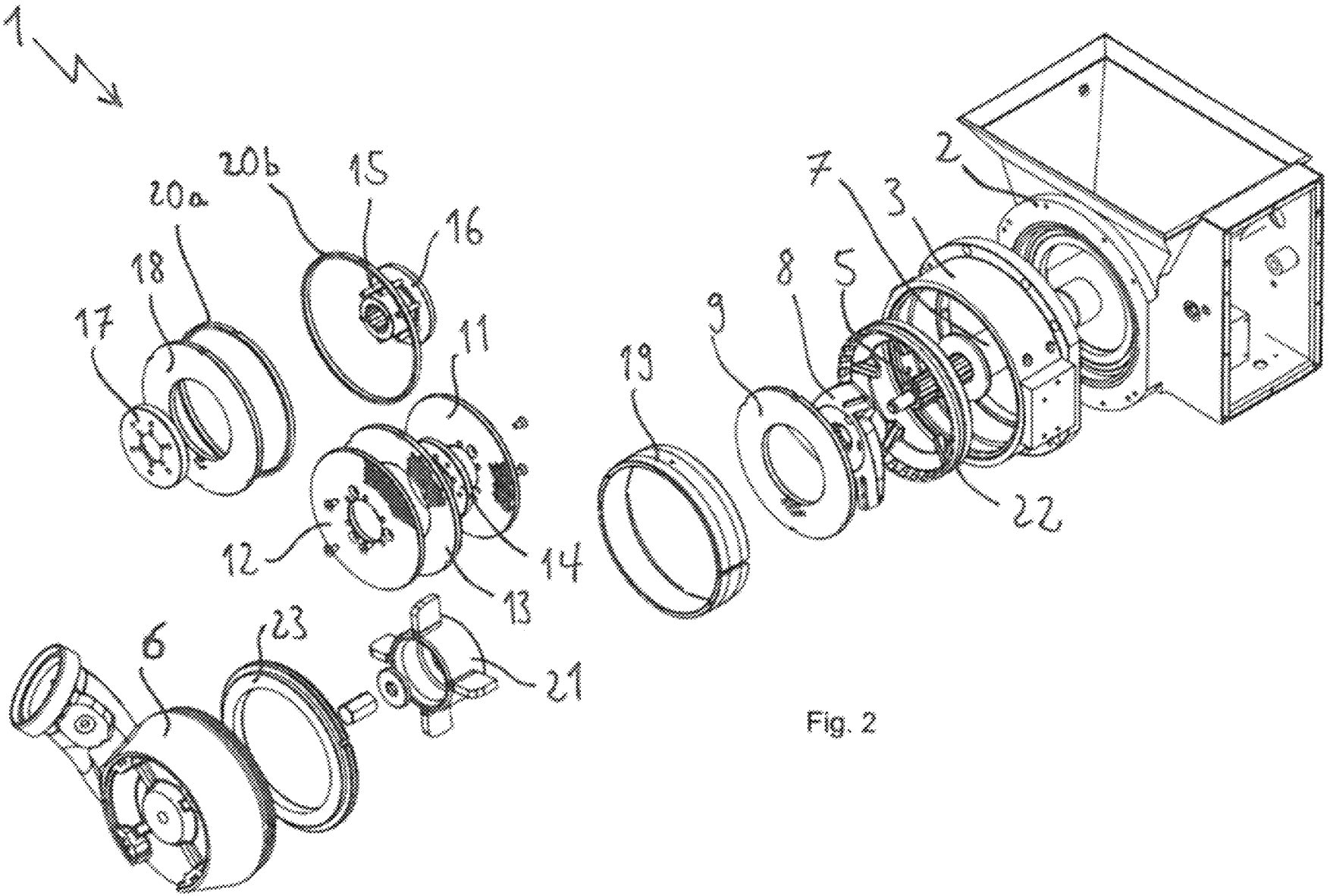
FIG. 2 is an exploded view of the mincing machine of FIG. 1.

FIG. 1 and FIG. 2 show a mincing machine 1, which has an inlet housing 2 to supply a product to be minced, such as meat (sausage meat), raw substances of animal or vegetable origin (e.g. fish and vegetables). A cutter set housing 3 is connected downstream to the inlet housing 2 in the conveying direction of the product wherein a cutter set 4 is accommodated in said cutter set housing 3, said cutter set being assembled on a driven, horizontally-mounted shaft 5 (motorized shaft) and which serves to mince the product, typically a foodstuff such as meat. An outlet housing 6 to discharge the minced product is mounted downstream of the cutter set 4 in the conveying direction.

As can be seen from FIG. 2, starting from the inlet housing 2, a spacer sleeve 7 and a cutter or blade head 8 are mounted successively on the shaft 5, said cutter head interacting with a stationary hole plate 9 arranged in the cutter set housing 3 to pre-mince the product. The cutter head 8 is mounted non-rotatably on the shaft 5 provided with grooves and is driven by it. The cutter head 8 exerts a centrifugal force on the product so that foreign bodies in particular are carried outwards in a radial direction where they are removed through a discharge valve.

An assembly having a first and second rotating hole plate 11, 12 between which a second stationary hole plate 13 is arranged, is mounted downstream in the conveying direction of the product. A spacer ring 14 is inserted in a central opening of the second stationary hole plate 13. As can be seen in FIG. 2, the first and second rotating hole plates 11, 12 are fastened by screws respectively on opposite sides of the spacer ring 14. The spacer ring 14, and thus both rotating hole plates 11, 12 can be rotated around the stationary hole plate 13.

In order to be able to transfer force from the shaft 5 to the spacer ring 14, six driving pins 15 of a driving bush 16 are inserted through corresponding through holes in the spacer ring 14. The free ends of the driving pins 15 are received by through holes in a disc-shaped cover 17 which is arranged to rotate in the central opening of a third stationary hole plate 18 and rotates in tandem with the shaft 5.

The arrangement with the two rotating hole plates 11, 12 as well as the first to third stationary hole plates 9, 13, 18 are clamped in the radial direction by means of an outer guide ring 19 and forms a hole plate module 10. The two rotating hole plates 11, 12 have a slightly smaller outer diameter than the stationary hole plates 9, 13, 18 which is why two spacer rings 20*a*, 20*b* shown in FIG. 2, are mounted on them to prevent the product from passing by. The cutter set 4 is completed by an ejector 21, mounted on the shaft 5 by means of a nut and by a thrust ring. The ejector 21 serves to place the minced product in a rotary motion before it is ejected through the outlet housing 6 out of the mincing machine 1.

The driving bush 16 is mounted non-rotatably on the shaft 5. As the shaft 5 is turned by the driving pins 15, the two rotating hole plates 11, 12 are also set in a rotary motion in order to interact with, respectively, two of the three stationary hole plates 9, 13, 18 to mince the product. A very small gap is formed between the stationary hole plates 9, 13, 18 and the rotating hole plates 11, 12. The product itself serves as a lubricant and prevents the hole plates 9, 11, 12, 13, 18 from wearing as the shaft 5 rotates. The hole plates 9, 11, 12, 13, 18 effect the mincing as well as an emulsification and homogenization of the product. Since the angle of the cutting edges is 90°, the cut material is more battered or crushed than cut so that the product appears creamier than is the case when mincing by the interaction of the cutter head 8 and the first stationary hole plate 9.

It is advantageous if the axial gap A between the front side of the first stationary hole plate 9 and the cutter head 8 can be adjusted within certain limits since, by using this method, it is possible to affect the degree of pre-mincing of the product as well as the throughput quantity and the heat transferred into the product. It can also be advantageous if the cutter head 8, or more accurately its cutter blades (not shown), is in contact with the first stationary hole plate 9 during the rotary motion in case they need resharpening. For the purposes stated, the maximum variation of gap A that is required is no more than a few millimeters, and as a rule only one or more tenths of a millimeter. Due to the very small gap or, respectively, the very short distance between the stationary hole plates 9, 13, 18 and the respectively adjacent rotating hole plates 11, 12, the rotating hole plates 11, 12 cannot be moved during the axial movement of the shaft 5.

However, in order to be able to adjust the gap A between the cutter head 8 and the first stationary hole plate 9, it is necessary to move the shaft 5 in the axial direction relative to the rotating hole plates 11, 12 which can be done with the aid of the driving bush 16 further described above, which is moved when the shaft 5 is moved axially while the hole plate module 10 mounted between the driving bush 16 and the cover 17 remains in place in the axial direction in the cutter set housing 3. A support ring 22 is mounted on that end of the cutter set housing 3 facing towards the inlet housing 2 and an annular thrust element 23 is mounted at the other end of the cutter set housing 3 facing towards the outlet housing 6 to fix the axial position of the cutter set 4.

Axial movement of the shaft 5 can be done by using a hand wheel, for example, while the mincing machine 1 is running in order to adjust the desired gap A between the first stationary hole plate 9 and the cutter head 8. Alternatively, instead of moving the shaft 5, the gap A can be realized also by moving the cutter set 4 or, respectively, the hole plates 9, 11, 12, 13, 18 relative to the cutter set housing 3 and with the shaft stationary in the axial direction, as described, for example, in DE 199 60 409 A1 cited at the beginning.

By pre-mincing with the cutter head 8, it is possible to design the diameters of the holes of the hole plates 9, 11, 12, 13, 18 so that they do not decrease in the conveying direction as has been the case up to now, but, instead, the diameters of the holes of front hole plates in the conveying direction can be selected to be smaller than the diameters of holes in hole plates further along in the conveying direction. For example, in FIG. 2, the diameters of the holes in the first stationary hole plate 9 are somewhat smaller than the diameters of the holes in the first rotating hole plate 11. The diameters of the holes in the other hole plates 13, 12, 18, on the other hand, decrease in the conveying direction of the product, as can be seen clearly in FIG. 2.

When the product needs to be minced more finely, further rotating cutter heads can be mounted before the cutter head 8 in the conveying direction, said further cutter heads interacting with further hole plates. Also, in the case of these cutter heads, the respective axial distance to the stationary hole plate can be adjusted by moving the shaft 5 in the axial direction. Naturally, in this case, the cutter set housing 3 must be made larger in the axial direction than is the case in FIG. 1 and FIG. 2.

In particular, instead of using the cutter set 4 described here, it is also possible to insert another type of cutter set into the cutter set housing 3, such as a cutter set in which hole plates interact solely with cutter heads in order to create a shear cut, or a cutter set in which the cutting is done additionally by means of a centrifugal cutting ring (rotor-stator principle) which is arranged downstream of the hole plates 9, 11, 12, 13, 18 in the conveying direction. Ideally, the different cutter sets are dimensioned such that they fit into the same cutter set housing 3. The mincing machine 1 therefore offers high flexibility as well as short setting times when changing the cutter sets.

What is claimed is:

1. A mincing machine for mincing a meat product, comprises:

at least one stationary hole plate disposed directly adjacent to at least one rotating hole plate which interact to mince the meat product;

a rotating cutter head mounted on a shaft, wherein said rotating cutter head is arranged upstream of the at least one stationary hole plates and the at least one rotating hole plate in a conveying direction of the meat product to be minced, wherein the rotating cutter head is disposed directly adjacent to the at least one stationary hole plate in order to interact with the at least one stationary hole plate to mince the meat product;

wherein the rotating cutter head defines a beginning of the conveying direction for the meat product; and wherein an axial gap between the rotating cutter head and the at least one stationary hole plate is adjustable while an axial gap between the at least one stationary hole plates and at least one rotating hole plate stays the same.

2. The mincing machine according to claim 1, wherein the shaft is mounted horizontally.

3. The mincing machine according to claim 1, wherein the at least one rotating hole plate is coupled to the shaft to move with the shaft.

4. The mincing machine according to claim 2, wherein the at least one rotating hole plate is coupled to the shaft to move with the shaft.

5. The mincing machine according to claim 1, wherein the shaft is mounted to be movable in an axial direction, wherein the axial direction is parallel with the shaft's axis of rotation.

6. The mincing machine according to claim 1, wherein a rotational force of the shaft is transferred to the at least one rotating hole plate and is carried out by driving pins driven by the shaft and passing through the at least one hole plate, the driving pins being movable in an axial direction relative to the at least one rotating hole plate, wherein the axial direction is parallel with the shaft's axis of rotation.

7. The mincing machine according to claim 5, wherein a rotational force of the shaft is transferred to the at least one rotating hole plate and is carried out by driving pins driven by the shaft and passing through the at least one hole plate, the driving pins being movable in the axial direction relative to the at least one rotating hole plate.

8. The mincing machine according to claim 7, wherein the at least one rotating hole plate comprises two rotating hole plates which are attached on opposite sides of a spacer ring, wherein the at least one stationary hole plate is fitted between the two rotating hole plates.

9. The mincing machine according to claim 8, wherein the driving pins pass right through through-holes in the spacer ring.

10. The mincing machine according to claim 1, wherein the diameters of the holes of the at least one stationary hole plate are smaller than the diameter of the holes of the at least one rotating hole plate.

11. The mincing machine according to claim 1, wherein an ejector rotating with the shaft is mounted downstream of the at least one stationary hole plate and the at least one rotating hole plate in the conveying direction.

12. The mincing machine according to claim 1, wherein the rotating cutter head is the only rotating cutter head of the mincing machine.

13. The mincing machine according to claim 1, wherein the at least one stationary hole plate comprises three stationary hole plates, and wherein the at least one rotating hole plate comprises two rotating hole plates, wherein the two rotating hole plates are disposed interleaved within the three stationary hole plates.

14. A mincing machine for mincing a meat product, the mincing machine comprising:

an inlet housing defining a beginning of a conveying direction for the meat product;

a rotating cutter head non-rotatably attached to a rotating shaft, the rotating cutter head disposed downstream of the inlet housing along the conveying direction;

a first stationary hole plate disposed downstream of the rotating cutter head along the conveying direction, wherein the first stationary hole plate is not attached to the rotating shaft, and wherein the first stationary hole plate is disposed directly adjacent to the rotating cutter head;

a first rotating hole plate disposed downstream of the first stationary hole plate along the conveying direction, wherein the first rotating hole plate is non-rotatably attached to the rotating shaft;

an outlet housing disposed downstream of the first rotating hole plate, the outlet housing defining an end of the conveying direction for the meat product; and wherein an axial gap between the rotating cutter head and the first stationary hole plate is adjustable while an axial gap between the first stationary hole plate and the first rotating hole plate stays the same.

15. The mincing machine of claim 14, wherein the rotating shaft is mounted to be movable in an axial direction, wherein the axial direction is parallel with the rotating shaft's axis of rotation.

16. The mincing machine of claim 14, including a second stationary hole plate disposed downstream to the first rotating hole plate along the conveying direction where the second stationary hole plate is not attached to the rotating shaft, including a second rotating hole plate disposed downstream to the second stationary hole plate along the conveying direction where the second rotating hole plate is non-rotatably attached to the rotating shaft, and including a third stationary hole plate disposed downstream to the second rotating hole plate along the conveying direction where the third stationary hole plate is not attached to the rotating shaft, and wherein the outlet housing is disposed downstream to the third stationary hole plate.

* * * * *